US007257978B2

(12) United States Patent
Koppinen et al.

(10) Patent No.: US 7,257,978 B2
(45) Date of Patent: Aug. 21, 2007

(54) COMPACT CANTILEVER ROLLING MILL AND A METHOD OF PRODUCING A METALLIC PRODUCT

(75) Inventors: Ilpo Koppinen, Delaware, OH (US); Brian Swank, Marengo, OH (US); Hans Keife, Västerås (SE)

(73) Assignee: Luvata Oy, Espoo (FI)

( * ) Notice: Subject to any disclaimer, the term of this patent is extended or adjusted under 35 U.S.C. 154(b) by 0 days.

(21) Appl. No.: 10/870,286

(22) Filed: Jun. 17, 2004

(65) Prior Publication Data

US 2005/0279149 A1 Dec. 22, 2005

(51) Int. Cl.
*B21B 29/00* (2006.01)
*B21B 13/14* (2006.01)
*B21B 39/20* (2006.01)

(52) U.S. Cl. ..... 72/243.6; 72/241.2; 72/252.5

(58) Field of Classification Search ..... 72/243.6, 72/241.1, 242.4, 248, 252.5, 237
See application file for complete search history.

(56) References Cited

U.S. PATENT DOCUMENTS 1,908,269 A * 5/1933 Palmgren ..... 72/237
4,581,911 A 4/1986 Shinomoto ..... 72/35
5,056,345 A 10/1991 Nonini ..... 72/21
5,524,469 A 6/1996 Sherwood ..... 72/241.2

FOREIGN PATENT DOCUMENTS

SU 0772617 * 10/1980 ..... 72/248

* cited by examiner

*Primary Examiner*—Derris H. Banks
*Assistant Examiner*—Teresa M. Bonk
(74) *Attorney, Agent, or Firm*—Morgan & Finnegan L.L.P.

(57) ABSTRACT

The invention relates to an apparatus for rolling a metallic product comprising a mill frame (18), a first cantilever roll shaft (19), a second cantilever roll shaft (20), both said roll shafts (19, 20) being mounted on the mill frame (18) with two sets of bearing assemblies (38, 39, 40, 41), a first rolling ring (21) mounted on the first roll shaft (19), a second rolling ring (22) mounted on the second roll shaft (20) said rolling rings (21, 22) forming a nip (23) in between, at least one ring (29) arranged with its inside surface (43) in rolling contact with the first roll shaft (19) and with at least one intermediate roll (27), which intermediate roll (27) is arranged also in rolling contact with the second roll shaft (20) and at least one drive end (42) arranged at the end of either roll shafts (19, 20) for driving the mill (16). The invention also relates to a method of producing a metallic product.

14 Claims, 4 Drawing Sheets

PRIOR ART

COMPACT CANTILEVER ROLLING MILL AND A METHOD OF PRODUCING A METALLIC PRODUCT

BACKGROUND OF THE INVENTION

This invention relates in general to mills for rolling metal products such as strands, strips, wires and profiles. More specifically, it relates to a cantilever apparatus of compact size for rolling a metallic material and a method of producing a metallic product.

Rolling mills are used for reducing the thickness and shaping of metallic products. There are two kinds of rolling mills. First there are rolling mills where work rolls have strong supportive bearings connecting the work rolls to the mill frame at both ends of the work rolls and the mill frame is covering the whole rolling mill. These are called "normal" rolling mills. The other kind of mills are called cantilever rolling mills, where the actual rolling is done outside the mill frame and the work rings are assembled on roll shafts which are supported by the mill frame only from the other side of the nip. The term "nip" is used herein to refer to the region where the work rolls or rolling rings are closest together.

The high forces associated with the rolling are guided to the work roll bearings/roll shaft bearings, which therefore have to be strong, that is heavily build. The forces directed to the bearings are over two times higher in cantilever rolling mills than in "normal" rolling mills due the structural design of the cantilever mill. The rolling forces in cantilever rolling mills are mainly carried by the heavy main bearings and the smaller bearings at the drive end of the roll shafts are just countering the bending moment caused by the rolling force. Traditional cantilever rolling mills are described e.g. in U.S. Pat. No. 4,581,911 and U.S. Pat. No. 5,056,345. The higher rolling forces with cantilever rolling mills are leading to even bigger/stronger bearings and mill frame construction as with the "normal" rolling mill and are preventing the use of cantilever rolling mill in some occasions.

In U.S. Pat. No. 4,581,911 are described a cantilever type rolling mill having a pair of roll shafts rotably supported in a roll housing on a roll stand. The assembly is designed to transmit torque to a ring roll by frictional force produced by application of compressive force on the opposite lateral sides of the ring roll.

In U.S. Pat. No. 5,056,345 are described a rolling stand with rolling rings supported as cantilever and having their axes at an angle to each other for the rolling of metallic products. The angle between the axes of the shafts is to compensate the bending of the shafts during rolling produced by the high rolling force. This high rolling force and the bending of the shafts are requiring very massive bearings and mill frame for the rolling stand.

In U.S. Pat. No. 5,524,469 are described a cantilevered cluster mill stand assembly for rolling long products. A basic improvement to normal cluster mill stands is the mounting of the rolling bearings upon a stationary cantilevered arbor directly under the roll ring, eliminating heavily loaded main reaction bearings within the stand housing in limited radial space. Individual drive motor assemblies for each shaft, rigidly coupled and directly supported by the drive shafts, are also advocated. However, even in this solution the forces with the support rolls are quite high because the unsuitable angles with the transfer of the rolling forces to the support rolls.

Despite the stronger bearings and other described solutions the cantilever rolling mills are not capable to handle as high rolling forces as "normal" rolling mills. This limits the use of the cantilever mills seriously despite of the many benefits achieved with this mill construction over "normal" mill construction.

SUMMARY OF THE INVENTION

The object of this invention is to eliminate the above-mentioned drawbacks of the prior art cantilever rolling mills and enable the use of lighter bearings and higher rolling forces with cantilever rolling mills.

It is also an object of this invention to provide an apparatus having a compact low cost construction without any parts having long lead times and a new method for rolling a metallic product.

The invention eliminates the heavy and expensive bearings altogether. This expands the usefulness of the cantilever mills into the applications where it could not be used earlier due the high rolling forces. This novel cantilever rolling mill is also much cheaper than the traditional cantilever rolling mill and also faster to build because the components having long lead times are eliminated.

Another object of this invention is to produce an apparatus and method for an easy adjustment of the gap in the nip.

The essential features and advantageous embodiments of the present invention are described herein.

BRIEF DESCRIPTION OF THE DRAWINGS

The invention is described in more details referring to following drawings, where.

DETAILED DESCRIPTION OF THE PREFERRED EMBODIMENTS

Figure 1:
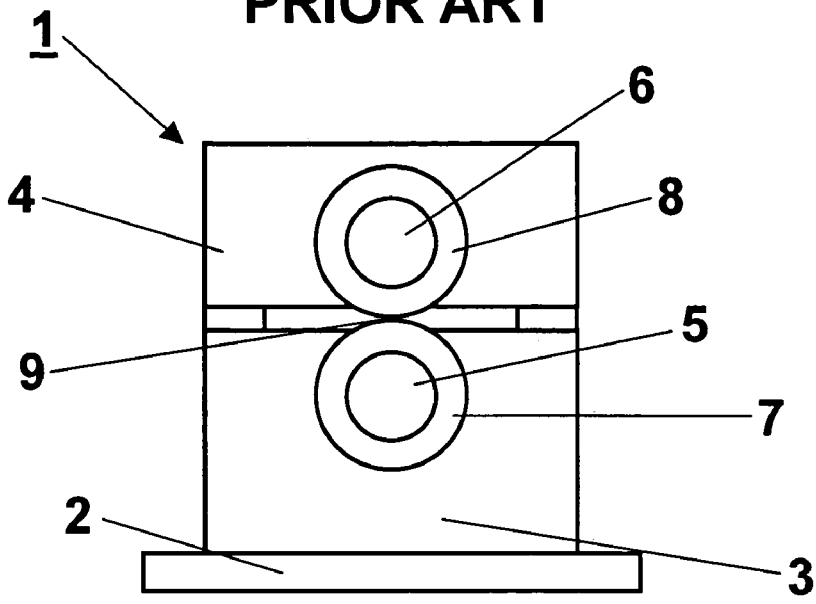
Fig. 1 PRIOR ART
FIG. 1 is simplified side view presentation of the main components of a prior art cantilever rolling mill.

In FIG. 1 is a simple presentation of a prior art assembly of typical cantilever type rolling mill 1. The rolling mill 1 has a base 2, which is supporting the lower mill frame 3. The lower mill frame 3 is supporting the upper mill frame 4. To the frames 3 and 4 are mounted lower and upper roll shafts 5 and 6. To the shafts 5 and 6 are mounted ring rolls 7 and 8, which are forming a nip 9 in between.

Figure 2:
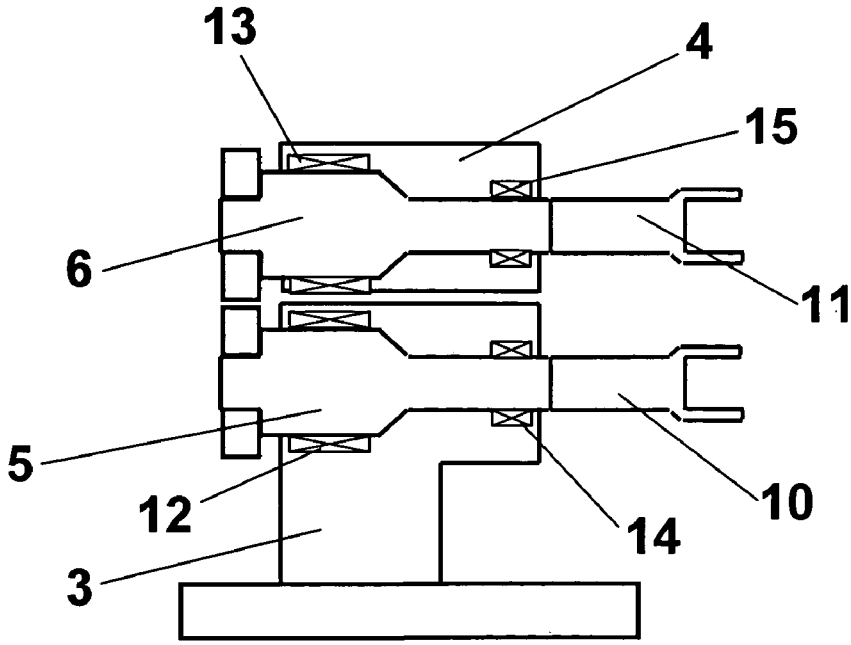
FIG. 2 is another view of a prior art cantilever rolling mill of FIG. 1.

FIG. 2 is another view of the prior art cantilever mill of FIG. 1. Both roll shafts 5 and 6 have drive ends 10 and 11 correspondingly at the ends of the roll shafts for driving the mill with drive motors. The roll shafts 5 and 6 are mounted to the mill frames 3 and 4 with heavy main bearing assemblies 12 and 13 and lighter bearing assemblies 14 and 15, which are situated closer to the drive ends 10 and 11 of the roll shafts. The heavy main bearing assemblies 12 and 13 are carrying the main part of the rolling forces. The light bearing assemblies 14 and 15 are just balancing the moment due the vertical distance between the rolling force vector and the supporting force vector of the main bearing assemblies 12 and 13. The requirement for strong bearings in all prior art solutions dictate the size of the overall construction and are making the mill frame very massive. Despite stronger bearings the prior art cantilever rolling mills are not useful in every occasions.

Figure 3:
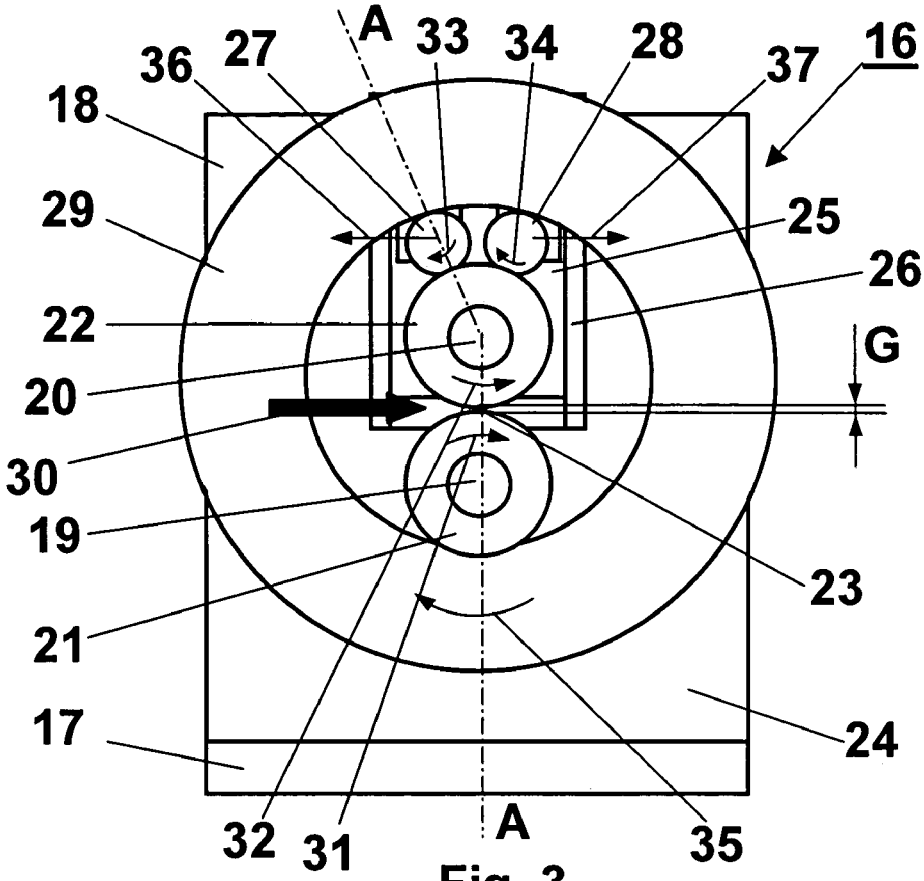
FIG. 3 is a schematic side view presentation of the main components of a cantilever rolling mill according to the invention.

In FIG. 3 is a schematic side view presentation of the main components of the cantilever rolling mill 16 according to the invention. The base 17 is supporting the frame 18 of the rolling mill 16. To the frame 18 are mounted the first roll shaft 19 and the second roll shaft 20, which have at their ends rolling rings 21 and 22 correspondingly, which are forming the nip 23. The frame 18 is advantageously constructed with two separate pieces 24 and 25 and the pieces are arranged in adjustable connection with one another for example with an arrangement of mechanical slides such as linear bearing assembly 26 and the first and second roll shaft 19 and 20 are mounted to different pieces of frame (described with more details later on).

In rolling contact with the second roll shaft 20 are assembled two intermediate rolls, first roll 27 and second roll 28. The purpose of these intermediate rolls 27 and 28 is to change the rolling direction of the second roll shaft 20 and on the other hand made possible to adjust the gap G in the nip 23. The third purpose for intermediate rolls 27 and 28 is to transmit the rolling force from the second roll shaft 20 to the ring 29.

Both shafts 19 and 20 and both intermediate rolls 27 and 28 are surrounded with a strong ring 29, which is in rolling contact with the first roll shaft 19 and with both intermediate rolls 27 and 28. When the metallic product is moving to the direction of the arrow 30 through the nip 23 the first roll shaft 19 is rotating according arrow 31, the second roll shaft 20 according to arrow 32, the intermediate rolls 27 and 28 according to arrows 33 and 34 and the ring 29 according to the arrow 35. The ring 29, which is surrounding the roll shafts 19 and 20 and the intermediate rolls 27 and 28 give them strong support and is carrying the main part of the rolling forces. This is enabling very light bearing assemblies (presented in FIG. 4) with the roll shafts 19 and 20.

The gap control in the nip 23 is arranged with the movement of the intermediate rolls 27 and 28. By moving the intermediate rolls 27 and 28 apart from each other according to the arrows 36 and 37 the gap G in the nip 23 is increased and vice versa. The magnitude of the gap G can be changed by moving either one of the intermediate rolls 27 or 28, or both of them. Another possibility is to move both intermediate rolls 27 and 28 to the same direction and maintain their distance constant to achieve the same effect to the gap G in the nip 26. Also the adjustment of the gap G can be done with a combination of any of these methods.

Figure 4:
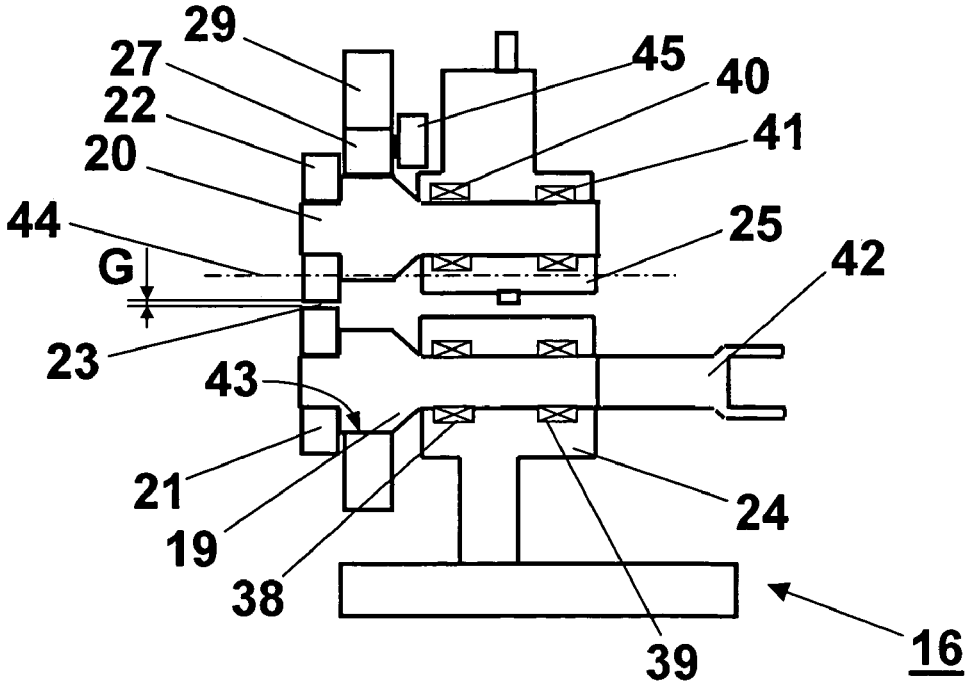
FIG. 4 is a cross-sectional view according to line A-A from FIG. 3.

FIG. 4 is a cross-sectional view according to line A-A from FIG. 3. The first and the second roll shaft 19 and 20 are mounted to the separate mill frame parts 24 and 25 with bearing assemblies 38, 39, 40 and 41. To the roll shafts 19 and 20 are assembled the rolling rings 21 and 22. Here the rolling rings 21 and 22 are for rolling a flat surface product, but any other kind of rolling rings can be used. The driving of the mill 16 is done with one drive motor (not shown) through one drive end 42 at the end of the first roll shaft 19. This is due the fact that all rotating parts 19, 20, 27, 28 and 29 are connected with rolling surface contacts together into one completeness. Nevertheless, it is always possible to arrange the drive end and drive motor to both of the roll shafts 19 and 20 if necessary. The cross-sectional area of the ring 29 is not limited to any shape. Only the rolling surface 43 of the ring 29 is advantageous to be flat. All rolling surfaces are essentially flat and parallel to the ring axis 44 to avoid any unnecessary forces in direction of the axis. The gap control is arranged with a gap control unit 45 situated between the mill frame 18 and the ring 29. With the gap control unit 45 the position of the intermediate rolls 27 and 28 is adjusted. The gap G in the nip 23 can be adjusted with the movement of the intermediate rolls 27 and 28 as explained earlier. The adjustment is advantageous to make by moving the intermediate rolls 27 and 28 closer or further apart from each other. Thus the adjustment can be made also by moving the intermediate rolls 27 and 28 together to the same direction.

Figure 5:
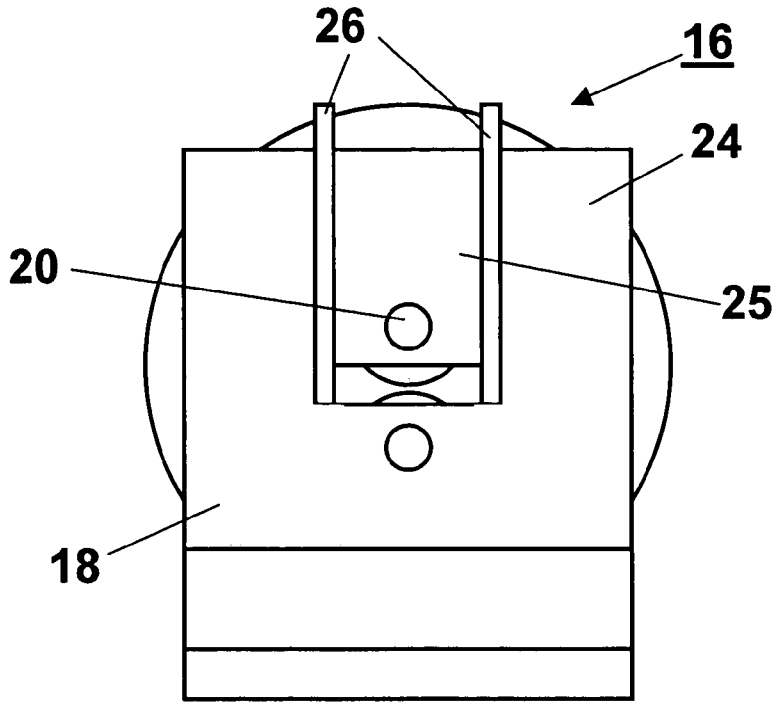
FIG. 5 is a schematic side view presentation from opposite direction as in FIG. 3 of the main components of the cantilever rolling mill.

FIG. 5 is another side view presentation of the same embodiment from opposite direction as in FIG. 3 of the main components of the cantilever rolling mill 16. The vertical movement of the second roll shaft 20 is made possible with mechanical slides such as linear bearing assembly 26 between the two mill frame parts 24 and 25 of mill frame 18, thus any other conventional method could be used.

Figure 6:
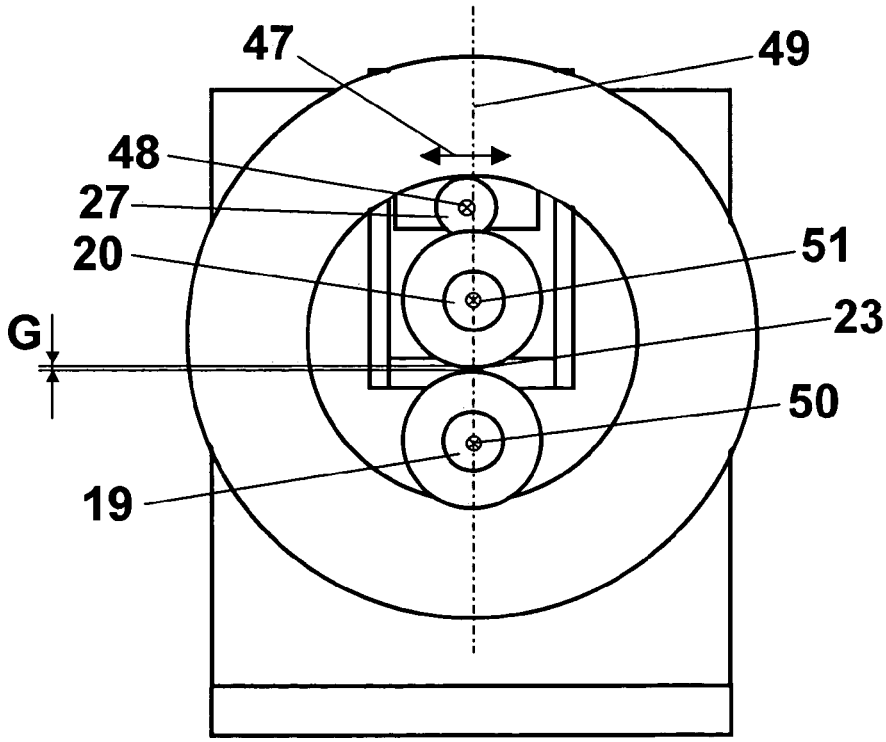
FIG. 6 is a schematic side view presentations of another embodiment of the invention and the adjustment of the gap in the nip.

FIG. 6 is a schematic side view presentation of another embodiment of the invention and the adjustment of the gap G in the nip 23. There is arranged only one intermediate roll 27 between the second roll shaft 20 and the ring 29 to change the rolling direction of the second roll shaft and to support it. The gap adjustment can be arranged by moving the intermediate roll 27 according to the arrow 47 basically the same way as with the two intermediate rolls in FIG. 3. When the rolling axis 48 of the intermediate roll 27 is moved further apart from the line 49 drawn between the roll shaft axes 50 and 51 the second roll shaft 20 can move further from the first roll shaft 19 and the gap G is increasing and vice versa.

Figure 7:
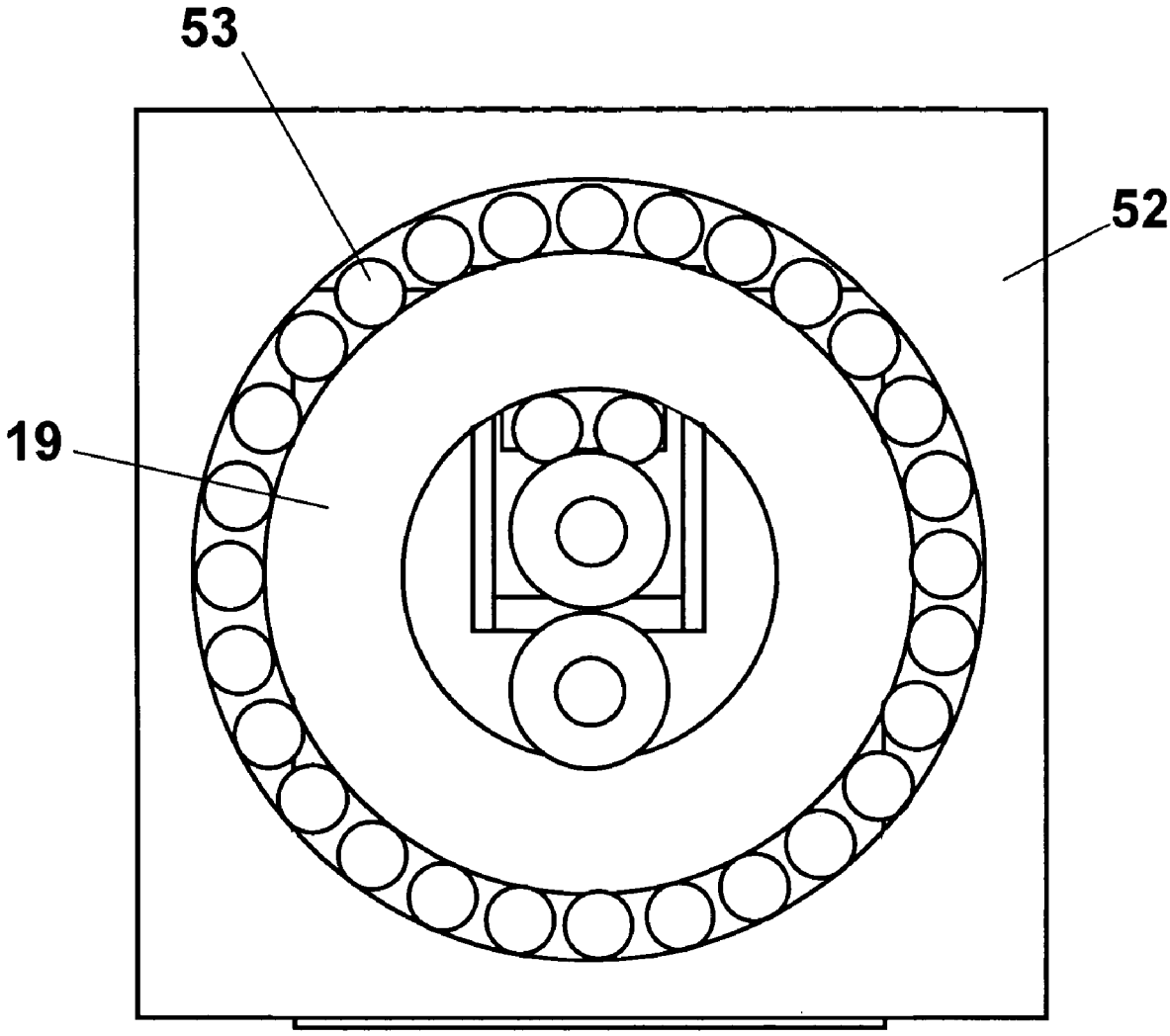
FIG. 7 is an embodiment with stationary cover.

In FIG. 7 is another embodiment of the present invention. If the rolling movement of the ring 19 is wanted to be eliminated for some reason, the ring can be surrounded by a stationary frame 52. Between the frame 52 and ring 19 are arranged a number of bearing rolls 53. With this arrangement the rolling movement of the ring 19 can be covered and the frame 52 is maintained stationary. The outer design of the frame 52 can be whatever the manufacturer decides. Here the frame 52 is presented in rectangular form. Also the bearing assembly can be any conventional bearing assembly.

With the above-described embodiments of the invention the cantilever rolling mill frame structure can be made significantly smaller. The rolling force is carried mainly by a strong ring. One shaft is directly transferring the rolling force to the inside of the ring and the other shaft transfers the force to the ring via one or two intermediate rolls. The roll gap is adjusted by changing the position of the intermediate roll(s). Attached to the second shaft is also a mechanism for keeping the shafts parallel (or in predetermined angle) while the roll gap is adjusted, for example by using linear bearing assembly. The forces needed for keeping the shafts parallel are only a small fraction of the rolling forces, therefore the bearing assemblies and other components in this mechanism need not to be as strong as the bearing assemblies in prior art cantilever rolling mills. Because all the main components are rotating together, it is only necessary to drive one shaft. In this sense the mill has an "internal gear box". If necessary, then off course both shafts can be driven.

The construction does not show a skew adjustment, but naturally it can be easily added if needed. When rolling a strip it is necessary to have a skew adjustment, whereas when rolling a wire it may not be needed.

While the invention has been described with reference to its preferred embodiments, it is to be understood that modifications and variations will occur to those skilled in the art. Such modifications and variations are intended to fall within the scope of the appended claims.

The invention claimed is:

1. An apparatus for rolling a metallic product comprising a mill frame, a first cantilever roll shaft, a second cantilever roll shaft, each said roll shaft being mounted on the mill frame with two sets of bearing assemblies, a first rolling ring mounted on the first roll shaft, a second rolling ring mounted on the second roll shaft, said rolling rings forming a nip in between wherein rolling forces are generated, at least one strong outer ring having sufficient strength to carry the rolling forces transferred thereto and having no bearing(s) or other structure contacting its outer surface arranged with its inside surface in rolling contact with the first roll shaft and with at least one intermediate roll, which intermediate roll is arranged also in rolling contact with the second roll shaft, and at least one drive end arranged at one end of either roll shaft for driving the mill.

2. An apparatus according to claim 1 wherein the mill frame is constructed of two pieces arranged in adjustable connection with one another and the roll shafts being mounted each on a separate piece of the mill frame.

3. An apparatus according to claim 2 wherein an adjustable connection is constructed with mechanical slides.

4. An apparatus according to claim 1 wherein a second intermediate roll is arranged in rolling contact between the second roll shaft and the at least one strong outer ring arranged with its inside surface in rolling contact with the first roll shaft.

5. An apparatus according to claim 1 wherein the apparatus further comprises a gap control device.

6. An apparatus according to claim 5 wherein the gap control device controls the position of the intermediate roll(s).

7. An apparatus according to claim 1 wherein the rolling surfaces of the roll shafts, intermediate roll(s) and inside surface of the strong outer ring are essentially flat and essentially parallel to the rolling axis of the ring.

8. A method for rolling a metallic product comprising the steps of:

mounting a first cantilever roll shaft with at least two bearing assemblies to a mill frame, mounting a second cantilever roll shaft with at least two bearing assemblies to the mill frame, arranging rolling rings to the roll shafts so that the rolling rings form a nip in between wherein rolling forces are generated, arranging at least one strong outer ring to close inside the rolls shafts, said strong ring having sufficient strength to carry the rolling forces transferred thereto and having no bearing(s) or other structure contacting its outer surface, arranging at least a first intermediate roll in rolling contact with the second roll shaft and the inside surface of the strong ring, arranging at least one drive end to one of the roll shafts for driving the mill, and directing the metallic product to the nip.

9. A method according to claim 8 wherein the method further comprises the step of:

arranging a second intermediate roll between the second roll shaft and the inside surface of the strong outer ring.

10. A method according to claim 8 wherein the method further comprises the steps of:

dividing the mill frame into two parts so that the roll shafts are mounted on separate parts and arranging the parts in adjustable connection with one another, and controlling the gap in the nip with gap control unit, which controls the position of the intermediate roll(s).

11. A method according to claim 10 wherein the gap control in the nip is done by moving one of the intermediate rolls.

12. A method according to claim 10 wherein the adjustment of the gap in the nip is done by moving both intermediate rolls in opposite directions or in the same direction.

13. An apparatus according to claim 1 wherein the outer surface of said strong outer ring is uncovered.

14. A method according to claim 8 wherein the outer surface of said strong outer ring is uncovered.

* * * * *